United States Patent [19]

Beasley, Jr.

[11] 4,082,386

[45] Apr. 4, 1978

[54] DRAWER FOR KNIVES AND OTHER UTENSILS AND TOOLS

[76] Inventor: Onan S. Beasley, Jr., Rte. 2, Box 1823, Madras, Oreg. 97741

[21] Appl. No.: 701,589

[22] Filed: Jul. 1, 1976

[51] Int. Cl.[2] ..... A47B 97/00

[52] U.S. Cl. ..... 312/204; 30/296 A; 206/565; 206/804; 312/313; 312/330 R

[58] Field of Search ..... 224/2 D, 29 R, 29 D, 224/29 G, 29 H, 29 J, 29 K, 29 L, 42.42 R, 42.42 A; 296/37.8, 37.9, 37.12; 206/45.18, 45.19, 45.15, 45.16, 425, 553, 557, 804, 562, 565; 312/204, 313, 330 R; 30/296 A

[56] References Cited

U.S. PATENT DOCUMENTS

| | | | |
|---|---|---|---|
| 1,845,470 | 2/1932 | Wood | 206/804 X |
| 1,937,222 | 11/1933 | Gallahan | 206/804 X |
| 2,492,697 | 12/1949 | Higley | 312/204 X |
| 2,514,014 | 7/1950 | Strumbos | 224/29 L |
| 2,768,631 | 10/1956 | Russell | 224/29 L X |
| 2,952,510 | 9/1960 | Naken | 206/553 X |
| 2,973,766 | 3/1961 | Milbourne | 296/37.9 X |
| 3,915,213 | 10/1975 | Graham, Jr. | 206/553 |

FOREIGN PATENT DOCUMENTS

| | | | |
|---|---|---|---|
| 1,143,726 | 12/1959 | Germany | 224/29 K |

*Primary Examiner*—John J. Love
*Assistant Examiner*—Winston H. Douglas
*Attorney, Agent, or Firm*—Klarquist, Sparkman, Campbell, Leigh, Hall & Whinston

[57] ABSTRACT

A knife drawer assembly includes a casing within which a drawer slides between open and closed positions. A stationary riser extends upwardly into the drawer from the floor of the casing through a bottom opening in the drawer. The riser supports a knife holder at an inclination within the drawer. The holder is pivoted at one end to the sides of the drawer near the back of the drawer for vertical swinging movement. As the drawer opens, the holder rides up over the riser, swinging the holder's outer free end upwardly toward the top opening of the drawer and projecting the knife handles out of the drawer where they can be easily grasped and removed from the holder and drawer. When the drawer closes, the holder rides downwardly along the riser to lie wholly within the drawer when it is fully closed.

10 Claims, 4 Drawing Figures

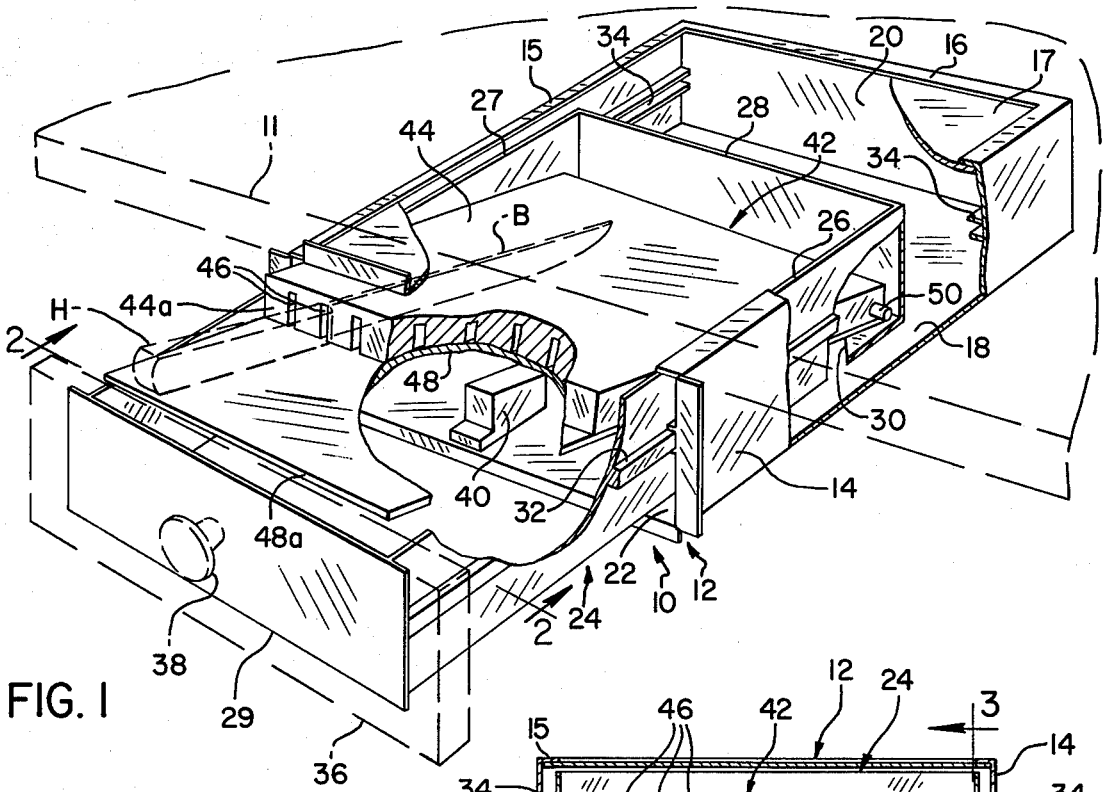
FIG. 1
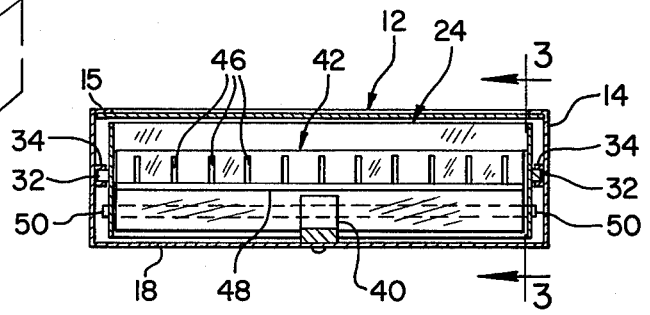
FIG. 2
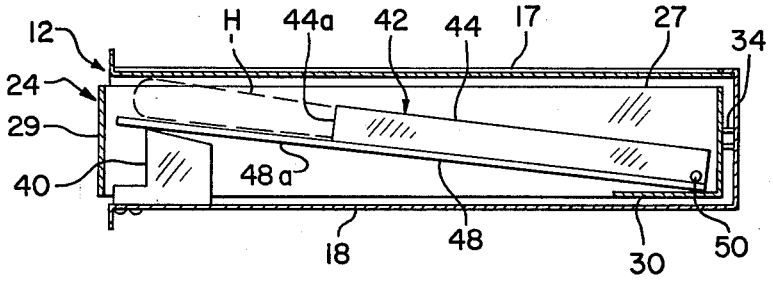
FIG. 3
FIG. 4
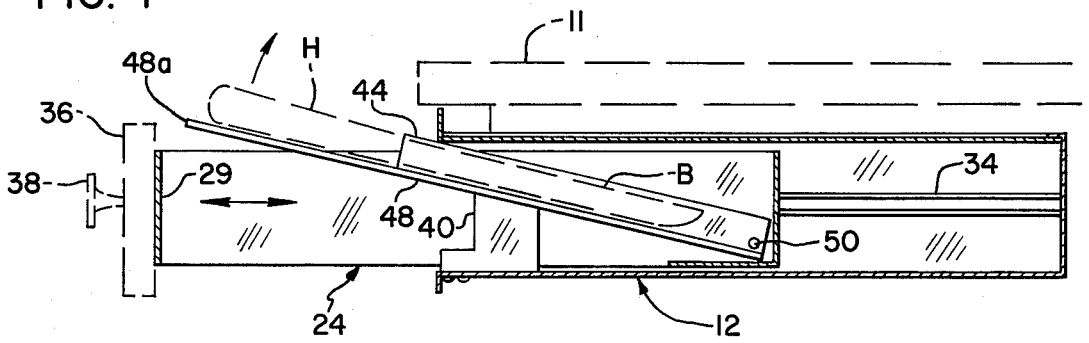

DRAWER FOR KNIVES AND OTHER UTENSILS AND TOOLS

BACKGROUND OF THE INVENTION

1. Field of the Invention

The present invention relates to a drawer for holding knives or other tools or utensils, and more particularly to a drawer with a built-in holder which retains and stores such items within the drawer in a safe and organized manner when the drawer is closed and yet provides ready access to the stored items to facilitate their easy removal when the drawer is opened.

2. Description of the Prior Art

Most drawers for holding knives, tools, or other utensils in the kitchen, workshop or other locations in the home, provide simply a large drawer space into which the various items are haphazardly placed. When the items within the drawer include knives or other sharp objects, someone reaching into the drawer without being careful can be cut accidentally by grabbing or otherwise contacting the sharp edge of such an object. Moreover, conventional drawers make it extremely difficult and frustrating to try to find a specific item desired. These problems have led to the development and use of various receptacles for placement in the bottom of a drawer with suitably shaped recesses or slots for retaining and separating various correspondingly shaped utensils in an organized manner. However, because such receptacles usually lie flat along the bottom of the drawer, access to and withdrawal of an item from its recess is often difficult. Also, someone trying to withdraw a knife or other sharp-edged item from its recess, especially if not careful or if in poor light, can still be cut by grabbing a sharp edge. Typical silverware and utensil drawers and receptacles of this type are shown, for example, in U.S. Pat. Nos. 2,952,510; 2,652,921; and 3,915,213.

A tray-type cigarette package has been proposed that would provide ready access to cigarettes when the tray portion of the package is pulled outwardly of a casing portion. In such construction the tensioning of a cord device interconnecting the tray and casing as the tray is pulled outwardly of the casing causes a false floor of the tray to rise at an inclination, elevating cigarettes in the tray above its top for ready removal therefrom. Such a cigarette package is shown in U.S. Pat. No. 1,937,222. However, the cigarette package construction shown in such patent is not applicable to household use as a knife, tool or utensil drawer because of the complexity of its construction, the temporary and disposable nature of the parts and the cord-type tray-elevating device which would be especially subject to malfunction and breakage with long-term repetitive use in conjunction with a drawer. Also the tray of such package has no particular means for separating, organizing or shielding the contents of the tray.

Accordingly, there is a need for an improved drawer construction capable of retaining and storing knives and other tools and utensils in an organized manner while providing ready and safe access to them when the drawer is open.

SUMMARY OF THE INVENTION

The present invention is a knife or other tool or utensil holding drawer assembly with a pull-out drawer and a built-in holder for knives or other items pivotally mounted within the drawer. As the drawer is pulled open, the tool holder swings upwardly about its pivot, exposing its outer free end at the front of the drawer opening for easy access to and selection of the items within the holder. When the drawer is closed, the holder swings downwardly to lie wholly within the drawer. The swinging action is preferably achieved with the use of a stationary riser extending upwardly into the drawer from a drawer casing through a bottom opening of the drawer to support the holder at an inclination within the drawer outwardly of its pivot mounting.

A primary object of the invention is to provide a drawer especially for knives and other sharp tools or utensils which stores such items in an organized manner when the drawer is closed and which enables their ready removal from the drawer in a safe manner when the drawer is open.

A more specific object is to provide a drawer with an internal holder for knives, tools and other objects which lies wholly within the drawer when closed and which swings upwardly toward the drawer opening at the front of the drawer when the drawer is pulled open so that the items in the holder can be readily removed therefrom for use.

Another specific object is to provide a drawer as aforesaid specifically adapted for holding knives with their blade portions shielded within a protective sheath or scabbard portion of the knife holder, and with their handles extending from the scabbard at the front of the drawer so that as the drawer is opened, the handles can be readily grasped to withdraw the knives safely from the scabbard and drawer for use.

Other objects are to provide a drawer assembly as aforesaid which can be prefabricated of sheet metal if desired, and which is simple and sturdy in construction, easy to operate and maintenance-free.

The foregoing objects, features and advantages of the present intention will become more apparent from the following detailed description, which proceeds with reference to the accompanying drawing.

BRIEF DESCRIPTION OF THE DRAWING

In the drawing:

FIG. 1 is a perspective view of a knife drawer assembly in accordance with the invention with portions broken away for clarity;

FIG. 2 is a front view of the knife drawer assembly of FIG. 1 with the front wall portion of the drawer removed, taken along the line 2—2 of FIG. 1;

FIG. 3 is a sectional view taken along the line 3—3 of FIG. 2; and

FIG. 4 is a view similar to that of FIG. 3 but showing the drawer open.

DETAILED DESCRIPTION OF PREFERRED EMBODIMENT

With reference to the drawing, FIG. 1 shows a drawer assembly 10 as it would appear mounted beneath a countertop 11 shown in phantom lines. The assembly includes a drawer casing 12 including upright opposite sidewalls 14, 15, joined by a back endwall 16 and top and bottom walls 17, 18, respectively. Together the casing walls define a drawer space 20 with a front opening 22 for receiving a drawer 24.

Drawer 24 is designed to slide within the drawer space of the casing and includes upright opposite sidewalls 26, 27 joined by back end wall 28 and a front end wall 29. The drawer is open at the top and bottom but does have triangular gusset plates 30 at the lower back corners of the drawer, one of which is shown in FIG. 1, joining the back wall to the opposite sidewalls to rigidify the drawer.

The opposite sidewalls of the drawer have longitudinal runners or rails 32 which ride within channel-shaped tracks 34 on the inside surfaces of the casing sidewalls for slidably supporting the drawer in the drawer casing.

Preferably the entire drawer assembly including casing and drawer as described thus far are prefabricated of sheet metal for easy installation. Front wall 29 of the drawer may be provided with a wooden drawer facing 36 as shown in phantom lines in FIGS. 1 and 4 with a drawer pull 38 to match existing wood cabinets in the kitchen or other room in which the drawer assembly might be installed. However, it should also be apparent that if desired the casing and drawer may be constructed of other suitable materials including wood or synthetics.

A riser 40 is fixed to the floor 18 of casing 12 near its front opening 22 and is centered between the opposite sidewalls of the casing. The riser extends upwardly from floor 18 into the drawer through the latter's bottom opening, terminating at its upper end approximately midway between the top and bottom of the drawer. Riser 40 may be constructed of wood or metal or any other suitable material and fastened by screws to the floor of the casing.

A holder means, in this case a knife holder indicated generally at 42, is mounted within drawer 24. The knife holder includes a block-like scabbard or shield portion 44 provided with a series of parallel knife slots 46 extending lengthwise of the drawer from front openings in the scabbard and spaced apart across the width of the drawer for sheathing the knife blades. The scabbard block 44 is mounted on a relatively thin rectangular base plate 48 forming the bottom wall of each scabbard slot. The base plate has a forward extension 48*a* beyond the front wall 44*a* of the scabbard, terminating near front wall 29 of the drawer. Base 48 of the holder extends nearly the full length of the inside of the drawer. An inner end portion of the holder is pivoted to the opposite sidewalls of the drawer by a pivot pin 50 so that the remainder of the knife holder is free to swing vertically about the transverse pivot axis of the pin.

The knife holder may be made of a synthetic material such as plastic or of wood or any other suitable material. If desired, the holder may also embody a knife-sharpening stone or other sharpening device. For this purpose one of the slots 46 can be shaped and dimensioned to provide a sharpening slot, with a portion of the slot being lined with a suitable knife-sharpening material.

Base plate 48 of the knife holder is supported at an inclination on riser block 40 when the drawer is both opened and closed, as will be apparent from FIGS. 3 and 4. The length of the scabbard is selected so that the blades B of knives will be housed and shielded within the scabbard slots 46 while the knife handles H extend outwardly thereof along forward extension 48*a* of base plate 48.

OPERATION

Riser 40 and knife holder 42 are positioned and arranged relative to one another with pivot pin 50 rearwardly of and below the top of riser 40 so that when the drawer is closed as shown in FIG. 2, the holder and its knives lie wholly within the drawer or at least within the drawer space of the casing; and so that when the drawer is opened as shown in FIG. 4, base plate 48 slides forwardly over the riser, causing the holder to swing upwardly about its pivot pin 50, allowing knife handles H and the front of the holder to clear the front opening of the drawer casing and project outwardly of the top access opening of the drawer at its front. Thus when the drawer is open, one or more of the knives can be readily removed from the holder simply by grasping their handles and sliding them out of their scabbard slots 46. When the drawer is closed, the holder base plate slides inwardly over the riser, causing the holder and its knives to descend back into the drawer about pin 50, where they are stored in an orderly manner with the blades safely shielded until the drawer is again opened and the knives removed.

Although the holder means has been described specifically as a knife holder with blade scabbard, it should be apparent that the holder could also be adapted for retaining other utensils such as forks and spoons or other tools such as chisels, screwdrivers, and the like. In fact, if desired, the holder means could be more in the form of a tray than a scabbard with the tray pivoting upwardly for easy access when the drawer is open merely by picking the desired utensil or tool from an appropriate recess or slot within the tray.

It should also be apparent that the positions and dimensions of the riser and holder may vary relative to the drawer. For example, pivot pin 50 could be positioned forwardly of the back wall of the drawer and riser 40 rearwardly of the front opening of the casing so long as the holder pivot is rearwardly of and below the top of the riser and the height of the riser modified accordingly to enable the holder to clear the top of the casing when the drawer is opened.

Having illustrated and described the principles of my invention with reference to what is presently a preferred embodiment, it should be apparent to those skilled in the art that the invention may be modified in arrangement, detail and form without departing from such principles. I claim as my invention all such modifications as come within the true spirit and scope of the following claims.

I claim:

1. A drawer assembly comprising:

a drawer casing means defining a drawer-receiving space with a front opening into said space, a stationary riser means extending upwardly from said casing into said space, a drawer adapted to be slidably received within said space through said front opening, said drawer including a front, a back, a top access opening and a bottom opening enabling said riser means to extend upwardly into said drawer when said drawer is both opened and closed, a holder means within said drawer for the retention of selected items, said holder means being pivoted to said drawer rearwardly and below the top of said riser means for vertical movement about a pivot axis transverse to the direction of sliding movement of the drawer, said holder means being supported forwardly of said pivot axis at an inclination within said drawer on said riser means in both the open and closed position of the said drawer such that when said drawer is closed, said holder means lies wholly within said drawer space and when said drawer is opened, a forward free end of said holder means lies outwardly of said front opening and projects upwardly toward the top access opening of said drawer to provide ready access to the items within said holder means.

2. A drawer assembly according to claim 1 wherein said holder means extends substantially the full length of the inside of said drawer and is pivoted at its innermost end adjacent to the back end of said drawer and said riser is positioned adjacent to the front opening of said casing.

3. A drawer assembly according to claim 1 wherein said holder means comprises a knife holder with a scabbard portion for shielding and retaining the blades of a plurality of knives with handle portions remaining exposed outwardly of said scabbard portion.

4. A drawer assembly according to claim 3 wherein said scabbard portion extends forwardly at an inclination from a rear portion of said drawer and terminates at a forward end between front and rear ends of said drawer, said scabbard having knife slots extending rearwardly from said forward end so that handle portions of knives within said scabbard portion are exposed at a front portion of said drawer.

5. A drawer assembly according to claim 3 wherein said scabbard retains knives with their handle portions closest to the front of said drawer and with the knives extending in the direction of sliding movement of the drawer with said riser and knife holder being arranged such that when said drawer is opened, the handles of knives within said scabbard are elevated above the top access opening of the drawer.

6. A drawer assembly according to claim 1 wherein said drawer is rectangular and has interconnected front, back and opposite sidewalls and an open top and bottom.

7. A drawer assembly according to claim 6 wherein said drawer is supported at its opposite sidewalls in said casing space on runners slidable in trackways at opposite sides of said casing.

8. A drawer assembly according to claim 1 wherein said casing and drawer are prefabricated of sheet metal.

9. A drawer assembly according to claim 8 wherein said drawer has a wood front face panel.

10. A drawer assembly according to claim 3 wherein said scabbard portion has parallel vertically extending slots for receiving knife blades, said slots being spaced apart across the width of said drawer and extending lengthwise toward the front and back of said drawer.

* * * * *